United States Patent [19]

Singer

[11] Patent Number: 5,020,239

[45] Date of Patent: Jun. 4, 1991

[54] AIR SUSPENSION ENROBER

[75] Inventor: Roy E. Singer, Crystal, Minn.

[73] Assignee: Wenger Manufacturing, Inc., Sabetha, Kans.

[21] Appl. No.: 558,235

[22] Filed: Jun. 8, 1990

[51] Int. Cl.[5] ..... F26B 17/10

[52] U.S. Cl. ..... 34/57 R; 34/57 E

[58] Field of Search ..... 34/10, 11, 34, 57 R, 34/57 E; 432/15

[56] References Cited

U.S. PATENT DOCUMENTS

| | | | |
|---|---|---|---|
| 1,942,868 | 1/1934 | Mitchell . | |
| 2,750,681 | 6/1956 | Berry . | |
| 2,797,908 | 7/1957 | Zubrzycki . | |
| 3,081,553 | 3/1963 | Miller | 34/57 E X |
| 3,152,876 | 10/1964 | Laing | 34/57 E X |
| 3,169,380 | 2/1965 | Callow et al. . | |
| 3,624,683 | 8/1966 | Lloyd . | |
| 3,668,784 | 6/1972 | Teague, Jr. et al. . | |
| 3,838,523 | 10/1974 | Hurd | 34/57 R X |
| 3,851,406 | 12/1974 | Dumitru et al. . | |
| 3,853,047 | 12/1974 | Dollbaum | 34/57 E X |
| 3,861,058 | 1/1975 | Whelan . | |
| 3,866,332 | 2/1975 | Hertz . | |
| 3,888,423 | 6/1975 | Ganiaris . | |
| 3,909,956 | 10/1975 | Bois . | |
| 3,964,175 | 6/1976 | Sivetz . | |
| 4,258,476 | 3/1981 | Caughey . | |
| 4,419,834 | 12/1983 | Scott . | |
| 4,461,093 | 7/1984 | Hultsch et al. . | |
| 4,587,744 | 5/1986 | Hüttlin | 34/57 E X |
| 4,642,905 | 3/1987 | Barlebo et al. | 34/57 E X |
| 4,649,653 | 3/1987 | Ameling | 34/57 E X |
| 4,691,448 | 9/1987 | Alstetter et al. . | |
| 4,715,188 | 12/1987 | Enkegaard . | |
| 4,777,735 | 10/1988 | Müller | 34/57 E |
| 4,785,551 | 11/1988 | Meyer . | |
| 4,787,152 | 11/1988 | Mark . | |

FOREIGN PATENT DOCUMENTS

| | | | |
|---|---|---|---|
| 0765615 | 9/1980 | U.S.S.R. | 34/57 E |
| 0680053 | 10/1952 | United Kingdom | 34/57 E |

*Primary Examiner*—Henry A. Bennett
*Assistant Examiner*—Christopher Kilner
*Attorney, Agent, or Firm*—Hovey, Williams, Timmons & Collins

[57] ABSTRACT

A material enrobing apparatus includes an elongated enrobing chamber, a material inlet adapted to receive material to be treated into the enrobing chamber, a material outlet adapted to deliver material from the enrobing chamber, and suspension means for creating and maintaining a circulating suspending flow of fluid within the enrobing chamber in a direction circumferential to the axis of the enrobing chamber. The fluid is adapted to suspend material in the enrobing chamber while the material is submitted to a treatment operation. The enrobing chamber includes an opening extending in a direction generally parallel to the axis along substantially the entire length of the enrobing chamber. The opening permits access to the enrobing chamber from outside the apparatus during operation thereof.

9 Claims, 3 Drawing Sheets

AIR SUSPENSION ENROBER

BACKGROUND OF THE INVENTION

1. Field of the Invention

The present invention relates generally to devices for handling granular or flake material and, more particularly, relates to a fluid suspension enrobing apparatus for suspending granular or flake material during a treatment operation.

2. Discussion of the Prior Art

It is known, e.g. from U.S. Pat. No. 3,964,175, to Sivetz, to provide a processing apparatus for roasting coffee beans, wherein a box-like chamber is provided in which the beans are levitated as a dense, uniformly recirculating mass by an upwardly directed airstream of heated air.

According to the Sivetz patent, a batch type roaster includes a roasting chamber, a heated air plenum separated from the roasting chamber by a distributer plate and an inclined inner plate, and a blower. A front wall is provided on the roasting chamber at a position generally opposite the inner plate, and includes a door which permits access to the roasting chamber for loading and unloading the roasting chamber before and after a roasting operation is carried out. The door forms a part of the front wall of the batch type roasting device and remains shut during a roasting operation in order to prevent material from escaping the roasting chamber as the material is circulated up along the front wall during a roasting operation.

A continuous coffee roasting system is also disclosed in the noted Sivetz patent which permits coffee beans to be continuously fed to and delivered from a roasting device while roasting of the beans is carried out. According to the disclosure relating to this continuous system, a plurality of separate, vertically descending roasting chambers are provided which are connected together via inlet hoppers and delivery chutes such that as coffee beans are delivered from one chamber of the system, they enter the next.

Each chamber of the continuous system includes an air distributor plate separating the chamber from a plenum located beneath the chamber. A front wall rises vertically upward from the separator plate of each chamber and includes a sight glass through which the process may be viewed from outside the chamber.

It is also known to provide an enrobing device including an elongated chamber having a material inlet at one axial end thereof and an outlet at the opposite axial end. In these known enrobing devices, means are provided for dispensing a treatment fluid within the chamber such that material passing through the chamber is coated with the fluid as the material passes from the inlet to the outlet. Typically, the movement of the material through the chamber is carried out by rotating the inner wall of the enrobing chamber and by providing vanes on the inner wall that move the material as the wall rotates about the axis of the chamber.

Several features of the known material handling devices present drawbacks which prevent the devices from operating in the most beneficial manner when used in handling granular or flake materials that are to be submitted to a treatment operation. For example, because it is frequently required for an enrobing apparatus to include a dispensing mechanism for dispensing a coating material or the like into the treatment chamber, it would be advantageous to provide means for permitting quick access to the mechanism in order to enable cleaning and maintenance thereof without substantial disassembly of the apparatus being required.

Another drawback present in known devices resides in the lack of any provision in the device for permitting an operator thereof to take samples from the treatment chamber without turning the device off and allowing the material within the treatment chamber to settle to the bottom thereof. Thus, in the known devices, it is time consuming and difficult to check the material within the treatment chamber during operation to see if operational conditions within the treatment chamber are providing satisfactory results.

Such periodic testing of the material being treated in the treatment chamber of an enrobing device is important, especially in continuous systems, to insure that processing of the material is completed before the material is delivered from the treatment chamber.

OBJECTS AND SUMMARY OF THE INVENTION

It is an object of the present invention to provide a material suspension or enrobing apparatus which overcomes the drawbacks present in known material treatment devices, and which permits access to the interior of a treatment chamber even during operation of the apparatus.

It is another object of the present invention to provide an enrobing apparatus which is safe to operate and is free of moving parts such that the apparatus presents no hazards and is easy to handle.

According to one aspect of the invention, a material enrobing apparatus comprises an elongated enrobing chamber, a material inlet adapted to receive material to be treated into the enrobing chamber, a material outlet adapted to deliver material from the enrobing chamber, and suspension means for creating and maintaining a circulating suspending flow of fluid within the enrobing chamber in a direction circumferential to the axis of the enrobing chamber, the fluid being adapted to suspend material in the enrobing chamber while the material is submitted to a treatment operation.

The enrobing chamber defines a reference axis and includes an opening extending in a direction generally parallel to the axis along substantially the entire length of the enrobing chamber. The opening permits access to the enrobing chamber from outside the apparatus during operation of the apparatus so that samples of material may be taken at any location along the length of the enrobing chamber. Thus, by this construction, an operator may constantly be aware of the conditions within the enrobing chamber and be better able to make adjustments in the apparatus to ensure that proper processing of the material is being carried out.

Further, by providing the opening in the enrobing chamber, material may be introduced anywhere along the length of the enrobing chamber through the opening such that a single apparatus may be used to carry out continuous treatment operations of varying duration depending on where the material is fed into the enrobing chamber.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
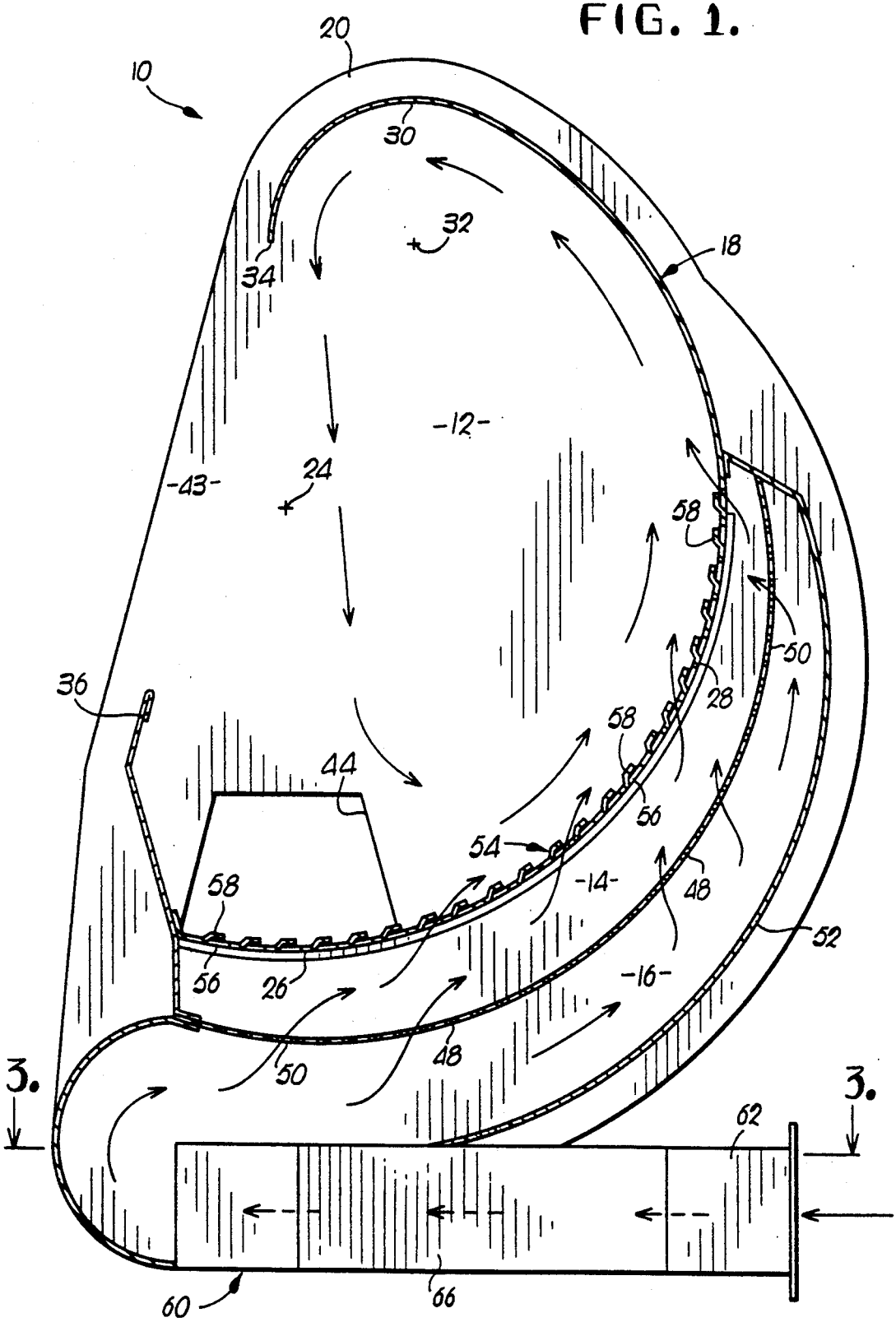
FIG. 1 is a side sectional view of a material suspension or enrobing apparatus constructed in accordance with the preferred embodiment of the invention.

An apparatus 10 constructed in accordance with a preferred embodiment of the invention is illustrated in FIG. 1, and includes generally, a treatment chamber 12, a plenum chamber 14, and a distribution chamber 16.

Figure 2:
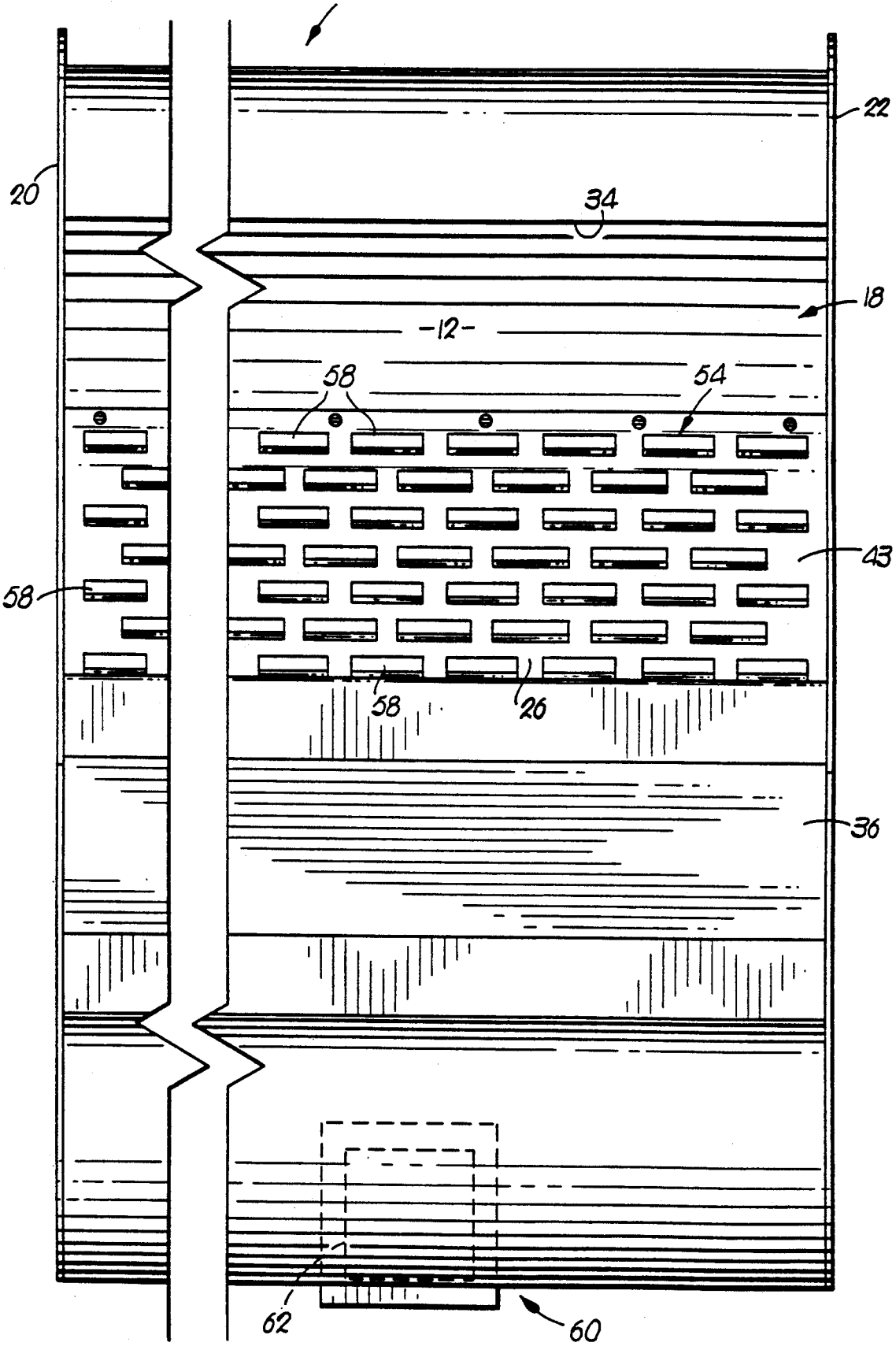
FIG. 2 is a front elevational view, partially broken away, of the material suspension or enrobing apparatus of FIG. 1.

The treatment chamber 12 is defined by a generally semicylindrical wall 18 which extends between two side walls 20, 22, shown in FIG. 2, and which is curved about a first reference axis 24 shown in FIG. 1. The wall 18 defines a floor 26 of the treatment chamber 12, a lateral guide surface 28 extending circumferentially upward from the floor about the reference axis 24, and an upper guide surface 30 also extending circumferentially about the first reference axis.

The upper guide surface 30 is preferably located at a substantially constant radial distance from a second reference axis 32 parallel to and offset from the first axis 24 such that the radial distance between the first reference axis and the upper guide surface 30 decreases in a direction extending away from the lateral guide surface 28 circumferentially toward an upper edge 34 of the wall, i.e. in the counterclockwise direction as shown in FIG. 1.

The treatment chamber 12 is further defined by an imaginary plane which extends between the upper edge 34 of the wall 18 and the floor 26, and which is roughly tangent to the upper guide surface 30 along a line extending collinear with the upper edge of the wall. A front wall 36 is connected to the wall 18 and extends generally radially inward relative to the first reference axis 24 of the treatment chamber 12, but is disposed outside the treatment chamber relative to the imaginary plane. The front wall 36 is connected to the lower edge of the wall 18 and may be mounted on the apparatus for pivotal movement about an axis extending in a direction parallel to the first reference axis 24 in order to permit adjustment of the angle of the front wall.

Figure 4:
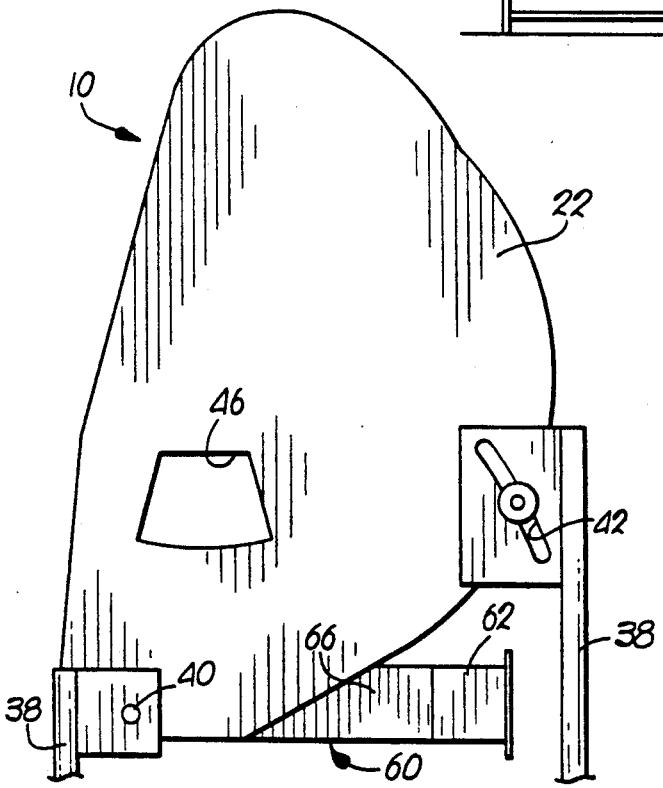
FIG. 4 is a side elevational view of the material suspension or enrobing apparatus.

Alternately, as shown in FIG. 4, it is possible to support the apparatus 10 on a frame 38 for pivotal movement relative to the frame about a pivot axis 40, by attaching the apparatus 10 to the pivot axis and providing an arcuate slot 42 in the frame which permits the apparatus to be secured to the frame at any desired angular position.

The front wall 36 and the upper guide surface 30 together define an opening in the front side of the treatment chamber 12 which extends axially along at least a portion of the length of the treatment chamber and circumferentially between the front wall 36 and the upper guide surface 30. As described more fully below with reference to the operation of the apparatus, the opening 43 permits ready access to the interior of the treatment chamber at any time during the operation of the apparatus 10 and allows an operator to constantly monitor the operation being carried out without having to view the operation through a cover. Although it is possible to close the opening if desired, one advantage of the preferred construction of the invention resides in the provision for leaving the opening in the treatment chamber unobstructed during operation of the apparatus in order to provide this ready access to the interior thereof.

Returning to FIG. 1, the side wall 20 of the apparatus includes an opening 44 through which material may be fed into or delivered from the treatment chamber 12. An opening 46 similar to the opening 44 is provided in the side wall 22, as shown in FIG. 4, and may also be used as either a material inlet or outlet.

The plenum chamber 14 extends axially between the side walls 20, 22 and is disposed radially outward of the treatment chamber 12 relative to the first reference axis 24 within a circumferential region including at least a portion of the floor 26 and lateral guide surface 28 of the wall 18. The wall 18 defines the radial inner extent of the plenum chamber 14 and the outer radial extent of the plenum chamber is defined by a sheet 48 having a plurality of perforations 50 provided therein, the perforated sheet 48 separating the plenum chamber 14 from the distribution chamber 16. The distribution chamber 16 is also disposed between the side walls 20, 22 within the circumferential region including the plenum chamber 14, and is defined by the perforated sheet 48 and by a sheet 52 of solid material disposed radially outward of the perforated sheet.

The wall 18 is provided with a plurality of louvers 54 within the region thereof adjoining the plenum chamber 14. Each of these louvers 54 includes a slot 56 passing through the wall 18 between the plenum chamber 14 and the treatment chamber 12, and a fluid directing flap 58 of wall material overlying the slot so as to direct fluid from the plenum chamber into the treatment chamber in a circumferential direction substantially parallel with the floor 26 and lateral guide surface 28. In this manner, suspension fluid delivered to the treatment chamber 12 from the plenum chamber 14 is directed circumferentially along the floor 26 and lateral guide surface 28 in a direction tending to lift the material in the chamber upward and along the wall 18 toward the upper guide surface 34.

As shown in FIG. 2, each louver 54 extends axially along only a small portion of the length of the treatment chamber 12, with a number of the louvers being disposed end-to-end along the total length of the chamber 12. Further, the louvers 54 are staggered in the circumferential direction of the treatment chamber in order that a uniform layer of suspension fluid is provided in the chamber during delivery of fluid thereto. Other constructions of the louvers are, of course, possible which would provide similar distribution within the treatment chamber sufficient to lift and suspend material within the chamber in an equivalent manner.

Figure 3:
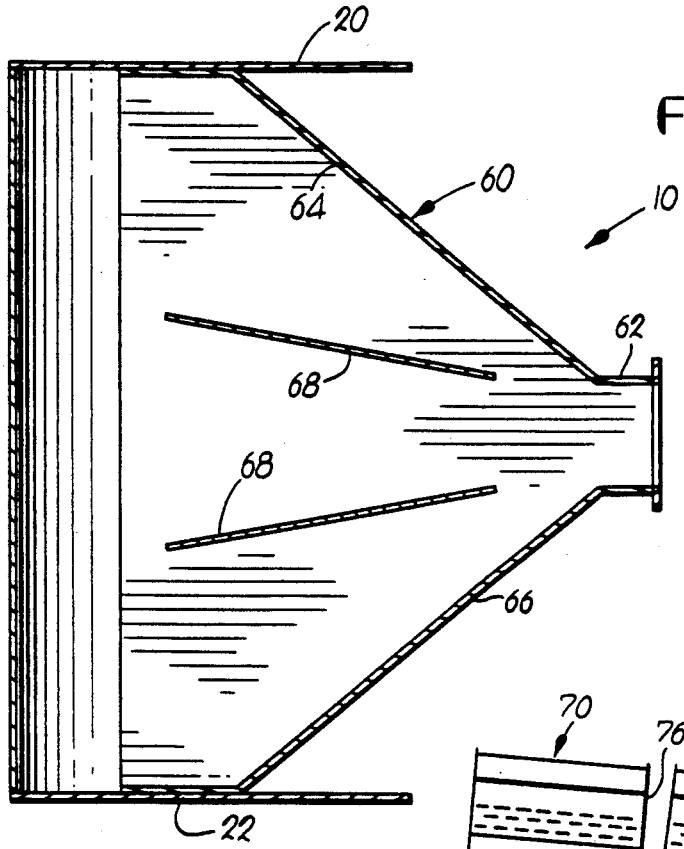
FIG. 3 is a sectional view taken along line 3—3 of FIG. 1.

The distribution chamber 16 is connected to a passageway 60 through which air or other suitable suspension fluid is fed to the distribution chamber. As shown in FIG. 3, the passageway 60 includes a duct 62 having divergent side walls 64, 66 extending to each of the side walls 20, 22, and stream splitters 68 are provided in the duct 62 such that the fluid is delivered to the distribution chamber 16 evenly along substantially the entire length of the apparatus.

The apparatus 10 of the preferred embodiment of the invention may be used in any process in which granular or flake material is to be submitted to a treatment process, such as a heating, cooling or coating operation, and in which it is desired that an even treatment be carried out on each grain or flake and on the load of grains or flakes as a whole.

Because such operations are commonly carried out in the food industry, it is preferred that all of the materials used in constructing the apparatus be of food grade quality, such as food grade stainless steel and the like. Further, suitable control of the suspension fluid is necessary in order to control the quality of the fluid to be used in suspending the grains or flakes during the treatment operation.

In use, a supply of granular or flake material is fed into the treatment chamber 12 via one of the openings 44, 46 while suspension fluid is supplied to the treatment chamber from a suitable supply of such fluid, e.g. air from a conventional blower (not shown). The suspension fluid provided by the blower travels through the duct 62 and distribution chamber 16, and is substantially equally distributed throughout the axial and circumferential region of the plenum chamber 14 by the perforated sheet 48 which equalizes the flow of fluid into the plenum chamber 14.

Thereafter, the suspension fluid passes through the louvers 54 into the treatment chamber 12, the fluid being fairly equally distributed among the louvers due to the equalized pressure within the plenum chamber. The flaps 58 on each of the louvers 54 directs the suspension fluid through the slots 56 in the circumferential direction of the treatment chamber 12 such that a dynamic layer of suspension fluid is provided along the floor 26 and lateral guide surface 28 which lifts the material in the treatment chamber and moves it in a circumferential direction up the lateral guide surface 28 toward the upper guide surface 30.

As material climbs the lateral guide surface 28 in the suspension fluid layer, gravity slows the circumferential velocity of the material at the same time that the material is redirected by the upper guide surface 30 in a direction toward the floor 26 so that the material travels in a direction generally parallel with the imaginary plane extending between the upper edge 34 of the wall 18 and the floor. Thus, the material is moved in a generally circumferential path from the floor 26, along the lateral guide surface 28, to the upper guide surface 30, and back to the floor.

In order to carry out a treatment operation on the material within the treatment chamber 12, the suspension fluid may be either heated or cooled such that as material is picked up by and carried with the fluid, heat is transferred between the material and the fluid. Because the material within the fluid is surrounded by and is constantly being rotated and moved within the fluid, improved heat transfer is achieved both via conduction between contacting grains or flakes and by transfer between the fluid and the material.

If a coating operation is to be conducted, a spray head or other suitable dispensing device may be provided within the treatment chamber through which a coating fluid is dispensed within the treatment chamber 12 while the material is being circulated by the suspension fluid. Because of the increased fluidity of the material resulting from the use of the fluid in suspending the material within the chamber 12, the coating fluid is evenly spread over the surface of each grain or flake and a consistent coating is achieved. If during any of the above-mentioned treatment operations, a sample is to be taken of the material within the treatment chamber 12, it is possible to simply insert a container, such as a bucket or the like, into the treatment chamber 12 through the opening 43 defined between the front wall 36 and the upper edge 34 of the wall 18. Because the material is retained within the treatment chamber 12 and does not spill from the front opening 43 due to the shape of the treatment chamber and the velocity of the suspension fluid within the chamber, it is not necessary to provide a cover on the opening, and it is possible to access the material in the chamber 12 simply by reaching into the chamber beyond the imaginary plane which extends between the upper guide surface 30 and the floor 26 and which is generally tangent to the upper guide surface along a line extending collinear with the upper edge of the wall.

Figure 5:
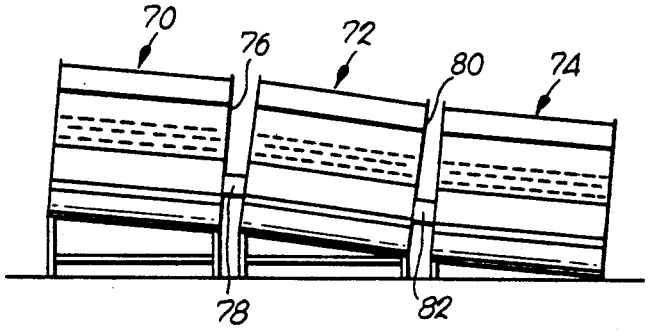
FIG. 5 is a front elevational view of a modular treatment system incorporating a plurality of suspension or enrobing stages constructed in accordance with the preferred embodiment of the invention.

As shown in FIG. 5, it is possible to arrange a plurality of apparatus modules 70, 72, 74, each similar to the apparatus 10, together in line with one another such that a plurality of treatment operations may be sequentially carried out on the material travelling through the modules.

The first module 70, located vertically above the second and third modules 72, 74 in the figure, is angled slightly relative to a horizontal plane so that, as material is fed into the treatment chamber of that module, the material travels generally toward an outlet end 76 of the module 70 while being circulated within the treatment chamber and submitted to a first treatment operation.

Thereafter, the material leaving the first module 70 travels through a duct 78 into the second module 72 which is also angled relative to horizontal. Within the treatment chamber of the second module 72, a further treatment operation is carried out on the material while the material travels gradually toward an outlet end 80 of the second module.

Upon leaving the second module 72, the material travels through a second duct 82 into the final module 74, where a finishing operation is conducted. During each of the operations, the material is readily accessible from outside the modules 70, 72, 74 simply by reaching into any of the treatment chambers thereof with a collection bucket and allowing circulating material to fall into the bucket. Further, the open fronts of the modules 70, 72, 74 allows an operator to visually confirm the movement of material within and through each of the modules and to monitor the operations without the need for shutting down any or all of them. Thus, a continuous operation may be conducted without sacrificing quality control of the product.

Another advantage realized from the arrangement of the present invention resides in the provision for material to be added or removed from the treatment chamber 12 at any position along the length of the apparatus. For example, if material is to be treated for a period less than the period for which the apparatus is set up, it is necessary only to pour the material into the front opening 43 of the chamber 12 at a desired location axially inward of the inlet so that the material is submitted to the treatment operation for a reduced amount of time. Similarly, if material delivered to the treatment chamber through one of the openings 44, 46 is to be removed prior to reaching the other opening 46, 44, it is possible to catch the material as it is circulated within the chamber so that the material may be removed from the chamber 12 before completing travel therethrough.

Although the invention has been described with reference to the preferred embodiment illustrated in the figures, it is noted that substitutions may be made and equivalents employed herein without departing from the scope of the invention as recited in the claims.

What is claimed is:

1. An apparatus for use in suspending material to be submitted to a treatment operation, the apparatus comprising:

an elongated treatment chamber extending axially in a first direction and having a front side and first and second axial ends, the treatment chamber being defined by a floor, a lateral guide surface which angles upward from the floor away from the front side, an upper guide surface spaced vertically from the floor, and a front wall extending upward from the floor along the front side of the treatment chamber, the front wall and the upper guide surface together defining an unrestricted opening in the front side of the treatment chamber which extends axially along at least a portion of the length of the treatment chamber and circumferentially between the front wall and the upper guide surface; and means for introducing a suspension fluid into the treatment chamber within a region extending axially along the length of the treatment chamber and circumferentially along at least a portion of the floor and lateral guide surface, the introduction means including fluid directing means for directing the suspension fluid in a direction substantially circumferential to the treatment chamber along said portion of the floor and lateral guide surface such that material in the treatment chamber is suspended in and carried by the suspending fluid from the floor upward along the lateral guide surface to the upper guide surface which directs the material vertically downward toward the floor past the opening.

2. The apparatus as recited in claim 1, further comprising a material inlet in the first axial end, and a material outlet in the second axial end, wherein material may be fed into the treatment chamber through the material inlet and suspended while a treatment operation is carried out on the material prior to it being delivered from the treatment chamber through the material outlet.

3. The apparatus as recited in claim 1, wherein the floor and lateral guide surface are together defined by a single, substantially semicylindrical chamber wall extending axially between the first and second axial ends of the treatment chamber.

4. The apparatus as recited in claim 1, wherein the upper guide surface is curved about a reference axis and includes an upper edge located vertically beneath the plane in which the reference axis is disposed, the upper guide surface extending axially between the first and second axial ends of the treatment chamber and circumferentially between the lateral guide surface and the upper edge.

5. The apparatus as recited in claim 1, wherein the front wall is pivotal about a pivot axis extending between the first and second ends of the treatment chamber.

6. The apparatus as recited in claim 1, wherein the means for introducing a suspension fluid into the treatment chamber includes a plenum chamber disposed radially outward of the region extending axially along the length of the treatment chamber and circumferentially along at least said portion of the floor and lateral guide surface, and a distribution chamber disposed radially outward of the plenum chamber for distributing suspension fluid to the plenum chamber at a substantially even pressure.

7. The apparatus as recited in claim 6, wherein the distribution chamber includes a perforated wall separating the distribution chamber from the plenum chamber and extending axially along the length of the treatment chamber and circumferentially along at least said portion of the floor and lateral guide surface, the perforated wall including a plurality of perforations through which suspension fluid is distributed to the plenum chamber.

8. The apparatus as recited in claim 6, wherein the fluid directing means includes a plurality of fluid passageways extending between the plenum chamber and the treatment chamber in the floor and lateral guide surface within said region.

9. An enrobing apparatus comprising:

an elongated treatment chamber defining a reference axis and including an opening extending in a direction generally parallel to the axis along substantially the entire length of the treatment chamber, the opening permitting access to the treatment chamber from outside the apparatus during operation of the apparatus;

a material inlet adapted to receive material to be treated into the treatment chamber;

a material outlet adapted to deliver material from the treatment chamber; and suspension means for creating and maintaining a circulating suspending flow of fluid within the treatment chamber in a direction circumferential to the axis of the treatment chamber, the fluid being adapted to suspend material in the treatment chamber while the material is submitted to a treatment operation.

* * * * *